United States Patent [19]

Haber

[11] 3,934,878

[45] Jan. 27, 1976

[54] ERRATIC MOVEMENT TETHERED BALL

[76] Inventor: Stephen K. Haber, 240 E. 48th St., New York, N.Y. 10017

[22] Filed: Aug. 28, 1974

[21] Appl. No.: 501,322

[52] U.S. Cl. ..... 273/95 A; 272/78

[51] Int. Cl.[2] ..... A63B 71/02

[58] Field of Search ..... 273/97 R, 95 A, 58 C, 98, 273/26 E, 29 A; 272/77, 76, 78

[56] References Cited

UNITED STATES PATENTS

| | | | |
|---|---|---|---|
| 3,776,551 | 12/1973 | Schaller | 273/95 A |
| 3,785,643 | 1/1974 | Rich | 273/78 |

*Primary Examiner*—Richard J. Apley
*Assistant Examiner*—Marvin Siskind
*Attorney, Agent, or Firm*—Kenyon & Kenyon Reilly Carr & Chapin

[57] ABSTRACT

A tethered ball game adapted for playing in a doorway by one or two players equipped with table tennis paddles. A ball is attached to one end of an elongated suspension member for hanging from the center of a doorway at a convenient height for striking the ball with the paddles. The suspension member has flexible filament upper and lower sections joined by an intermediate inertia member, preferably in the form of a straight stiff wire link heavier than the combined weight of the ball and the upper and lower flexible sections. The inertia member contributes an erratic motion to the ball thereby enhancing the interest of the game.

4 Claims, 2 Drawing Figures

ERRATIC MOVEMENT TETHERED BALL

BACKGROUND OF THE INVENTION

1. Field of the Invention

The present invention relates to paddle ball games and particularly to paddle games using a tethered ball.

2. Description of the Prior Art

Tethered ball games are well known which are intended to be played by a single person, and the ball is tethered by an elastic cord so that it will return to the player after being struck by a bat, club or paddle. In one such type of game a small rubber ball is tethered to the center of a wooden paddle by a rubber band. The player hits the ball hard enough to drive it beyond the unstressed length of the rubber band, thereby causing the band to stretch and to return the ball to the player. The object of the game is to repeat this process as many times as possible without missing the ball on its return travel.

A tennis-like game for two players using badminton-style racquets comprises a light weight inflatable ball on the end of a rubber band that is tied to the center of a bar mounted a few inches off the floor on weighted end supports. The players stand on opposite sides of the bar and try to hit the ball back and forth over the bar. The rubber band, being tied to a fixed point below the midpoint of the ball's normal trajectory exerts a pull at an angle to that trajectory when it becomes taut; whereas the rubber band in the first-described game exerts a pull substantially in line with the ball's trajectory. In both games, however, the pull is exerted along a straight line from the point of attachment, and the pull is exerted only at the end of ball travel.

In another type of tethered ball game for two players, a ball is suspended by a flexible cord from the top of a pole, and each player tries to hit the ball, either with his hands or a paddle, past the other player. If one succeeds, the ball will orbit the pole and come around behind the one player, who then tries to repeat his success and continue the ball in orbit around the pole in ever-decreasing circles until the cord is completely wound up on the pole. The functions of the cord in this game differ from those of the rubber band of the preceding games in that it exerts a continuous centripetal pull on the ball and is used to immobolize the ball against the pole in the fully-wrapped condition to signal the scoring of a point.

Although each of the tether ball games described above has its own distinctive characteristics and method of play, a feature common to all is that the tether line, whether elastic or inelastic, is uniform and flexible throughout its length. Thus, it exerts a pull on the ball in a straight line along its free length.

SUMMARY OF THE INVENTION

It is a primary object of the present invention to provide a tethered ball type of paddle game in which the tether line includes an intermediate inertia member for imparting erratic behavior to the ball motion.

Another object of the invention is to provide a tethered ball type of paddle game that can be played safely indoors in a very limited area.

Another object of the invention is to provide a paddle and tethered ball game that can be played by either one or two persons.

Still another object of the invention is to provide a tethered ball game that can be set up and taken down rapidly and easily.

It is another object of the invention to provide a tethered ball and paddle game that makes maximum use of available structure, and the additional components of which take up an absolute minimum amount of storage volume.

These and other objects are accomplished in the game of the present invention which comprises a ball and an elongated suspension member for suspending the ball from the center of a doorway at a height convenient for striking the ball with a paddle held by at least one player standing on one side of the doorway.

An important characteristic of the invention lies in the construction of the suspension member, which includes an upper portion, an intermediate portion, and a lower portion. The upper and lower portions comprise lengths of a flexible filament, while the intermediate portion comprises an inertia member that is heavier than the combined weight of the ball and the upper and lower filament portions. The inertia member preferably is in the form of an elongated rigid link, the lengths of the upper and lower flexible portions and the intermediate rigid link being approximately equal.

In the preferred embodiment of the game, the ball is between 1 and 2 inches in diameter, preferably between 1½ and 1¾ inches, and weighs between 0.1 and 1 ounce, preferably about 0.2 ounce. The upper and lower portions of the suspension member are formed of flexible, monofilament plastic line, such as nylon fishing line, and the intermediate rigid link is a piece of stiff wire between one-sixteenth and one-eighth inch in diameter and between 6 and 24 inches long, preferably between 12 and 18 inches long. The lengths of the upper and lower portions of the suspension member are approximately equal and, for a standard height of the doorway, the lengths of all three sections are roughly equal.

The foregoing and other features and advantages of the invention will become more apparent from the following description of the preferred embodiment with respect to the accompanying drawing.

DESCRIPTION OF THE PREFERRED EMBODIMENT

Figure 1:
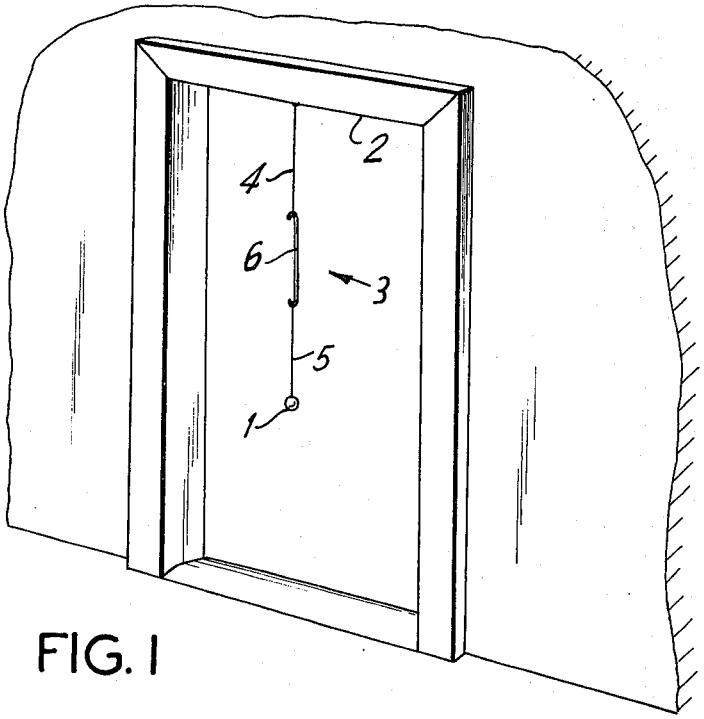
FIG. 1 is a perspective view of the ball and suspension member installed in a doorway ready for play.

In FIG. 1 a tethered ball 1 is shown suspended from the center of a door frame 2 by a suspension member 3 comprising an upper portion 4, a lower portion 5, and an intermediate portion 6. The upper and lower portions are flexible lightweight filaments. A particularly preferred filament material is monofilament nylon, but string or heavy thread also may be used.

Intermediate portion 6, an important feature of the present invention, functions as an inertia member, preferably in the form of a rigid elongated link such as a straight stiff wire between one-sixteenth and one-eighth inch in diameter. The wire may be looped at either end to provide a convenient means for attachment of the upper and lower filaments.

The height of the ball above the floor is typically about three feet, but it may be varied to suit individual players. Any convenient means can be used to attach the upper filament portion to the door frame, such as a tack or a hook and eye. For a conventional seven-foot door frame the overall length of the suspension member will be about 4 feet, and it is preferred that the upper and lower portions be roughly equal in length.

The intermediate stiff wire inertia member may be from 6 to 24 inches long, preferably between 12 and 18 inches long, although shorter lengths of heavier wire or even a concentrated mass inertia member may be used. Best results are obtained, however, if the intermediate member is about 15 inches long and the upper and lower flexible filaments are of roughly the same length.

The inertia member should weigh more than the combined weight of the ball and flexible filament portions for best results. As an example, a preferred embodiment employs a stiff wire intermediate portion weighing about one-half ounce and about 15 inches long. The upper and lower filament portions are 40 lb. test monofilament nylon fishing line, and the ball is made of high impact plastic, is hollow, is about 1.7 inches in diameter, and weighs about 0.1–0.2 ounce. The total weight of all the suspended components of the game is thus less than one ounce, making the game very safe for play in a confined area, such as the average city apartment.

Although the game may be played by only one person, it is a great deal more fun with two players. The players can make up their own rules if they like, but for greatest enjoyment it is recommended that table tennis serving and scoring rules be followed. Since there is no net or table, these rules must be modified, for example, by requiring that each player must hit the ball a specified distance past his opponent's side of the doorway, each player must strike the ball to return it to the other side, and if the ball hits the door frame or adjacent walls, it is out of bounds.

Figure 2:
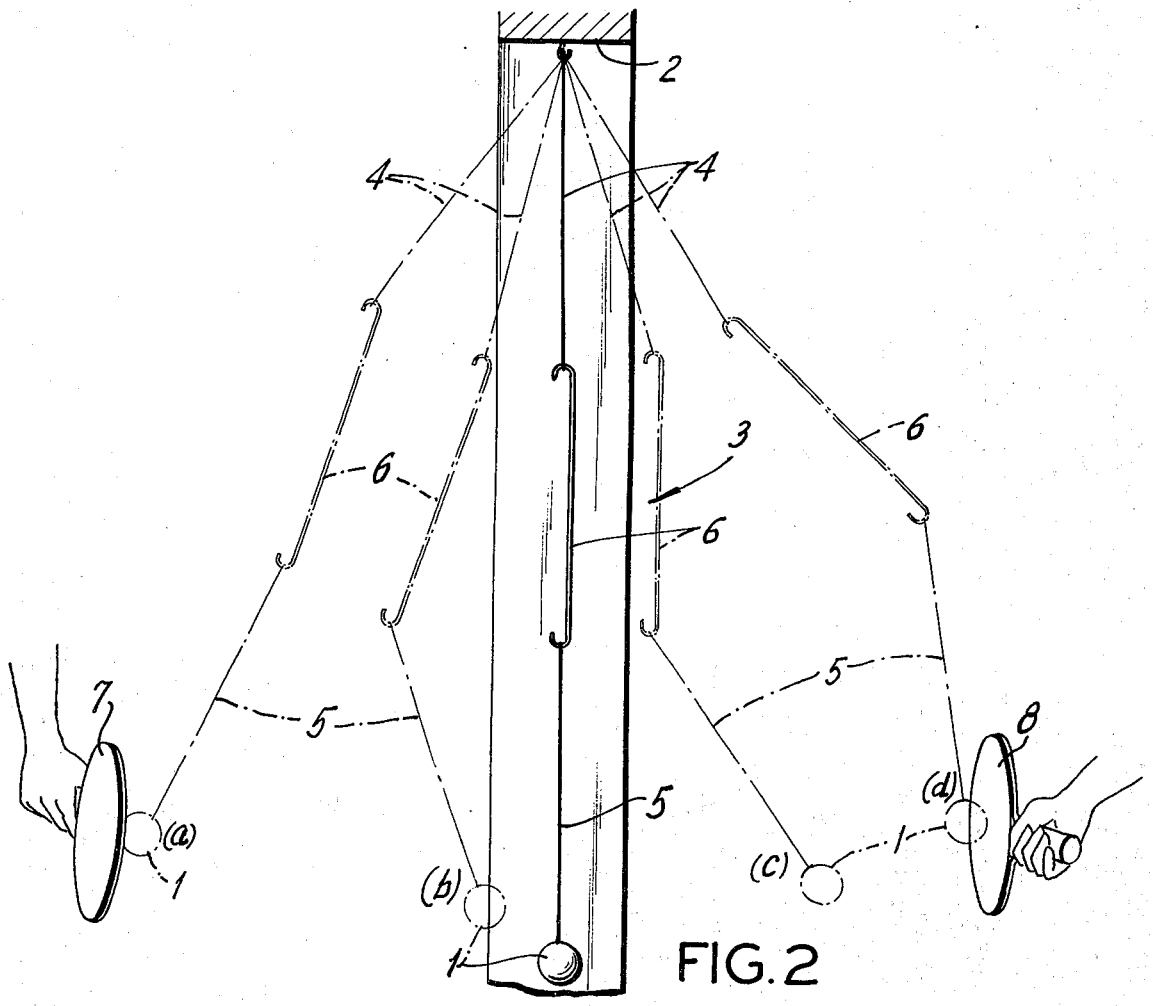
FIG. 2 is a side view depicting in "stop action" typical successive positions of the three portions of the suspension member after the ball has been struck by one of the players.

Referring to FIG. 2 (position *a*) the game is started by one player drawing the ball approximately 2 to 3 feet to his side of the doorway and striking it lightly with a paddle 7 (preferably about twice the size of a conventional table tennis paddle) to cause it to swing through the doorway on the end of the suspension member. As shown by the stop action sequence of FIG. 2, the upper flexible portion 4 and the intermediate rigid portion 6 will tend to swing like a simple pendulum.

Depending on how hard the ball is struck, it will tend to swing ahead of the lower end of inertia member 6 (position *b*) thereby exerting a forward pull on that end. The period of oscillation of the ball with respect to the lower end of member 6 is a fraction of the period of the overall system; so the ball starts to swing back (position *c*), while the lower end of member 6 is swinging ahead of its upper end.

At some subsequent point in the swing (position *d*) the opposing player hits the ball back with a paddle 8. Since any sideward component of the striking force will cause similar complex side-swinging motion, it will be apparent that the ball soon adopts a highly erratic motion so that considerable skill is needed for each player to return the ball through the doorway without allowing it to strike the side posts or walls.

From the foregoing description it will be apparent that the game of the present invention will provide exercise and entertainment to persons of all ages in even a very small apartment. The tethered ball is rapidly set up and taken down, and by mounting it in a doorway, the limits of the "playing field" are established automatically. Furthermore, no furniture needs to be moved out of the way because no more playing space is required than is normally available for passage between rooms.

When taken down for storage, the game components fit easily into a small drawer or cabinet, yet they are ready instantly for use on the next occasion.

As can be seen from the various positions of FIG. 2, the relative lengths of the upper and lower flexible portions and the rigid intermediate inertia member, and the relative weights of the ball and the inertia member, will all affect the movement of the ball. Accordingly, these dimensions and weights can be varied as desired, although the preferred values given above provide the best combination for most players.

In addition, the paddle size may be varied from the preferred size mentioned above. For example, regulation ping-pong paddles may be used, particularly by more skillful players. For the average person, however, a paddle about twice that size (e.g. approximately the size of a regulation paddle tennis paddle) is preferable.

I claim:

1. A tethered-ball game adapted for playing in a doorway by players equipped with paddles comprising:

a ball between 1 and 2 inches in diameter and weighing between 0.1 and 1 ounces;

at least one flat paddle adapted to be held by at least one player for striking the ball; and an elongated suspension member for suspending the ball from the center of a doorway at a height convenient for striking the ball with a paddle held by a player standing on one side of the doorway, the suspension member having an upper portion, an intermediate portion, and a lower portion, the upper and lower portions comprising lengths of a flexible filament and the intermediate portion comprising an elongated thin stiff link member having a length of approximately 6–24 inches and weighing less than 1 ounce but more than the combined weight of the ball and the upper and lower filament portions.

2. The game of claim 1 wherein the length of the intermediate portion is between approximately 12 to 18 inches.

3. The game of claim 1 wherein the weight of the ball is between approximately 0.1 to 0.2 ounces.

4. The game of claim 1 wherein the length of the intermediate portion is approximately 15 inches.

* * * * *